United States Patent [19]

Nakagawa et al.

[11] 4,192,404

[45] Mar. 11, 1980

[54] MUFFLER FOR INTERNAL COMBUSTION ENGINES

[75] Inventors: Takashi Nakagawa, Tokorozawa; Tadashi Sugiuchi, Niiza; Kanau Iwashita, Tokyo, all of Japan

[73] Assignee: Honda Giken Kogyo Kabushiki Kaisha, Tokyo, Japan

[21] Appl. No.: 908,261

[22] Filed: May 22, 1978

[30] Foreign Application Priority Data

May 25, 1977 [JP] Japan ..... 52/60880

[51] Int. Cl.[2] ..... F01N 1/08

[52] U.S. Cl. ..... 181/272; 181/281

[58] Field of Search ..... 181/250, 255, 235, 272, 181/274, 275, 279–281

[56] References Cited

U.S. PATENT DOCUMENTS 2,274,599 2/1942 Freemans ..... 181/255

*Primary Examiner*—L. T. Hix

*Assistant Examiner*—Benjamin R. Fuller

*Attorney, Agent, or Firm*—Irving M. Weiner; Pamela S. Burt

[57] ABSTRACT

An expansion-type muffler for internal combustion engines, interposed in an exhaust system, and provided with a chamber with a substantial volume. The chamber communicates with the up-stream and down-stream sides of the exhaust system. A plate member is connected with an inner wall of the muffler body, and is provided in the body so that all of the connecting points between the plate member and the inner wall are not disposed in the same plane perpendicular to the longitudinal axis of the muffler body.

6 Claims, 8 Drawing Figures

MUFFLER FOR INTERNAL COMBUSTION ENGINES

The present invention relates generally to improvements in a muffler of a type wherein a partition plate or reinforcing plate is provided within an exhaust expansion chamber connected to an exhaust pipe of an internal combustion engine.

More particularly, the invention relates to a muffler for internal combustion engines wherein a plate member, provided in an expansion chamber, such as a partition plate having a communicating pipe, or a reinforcing plate for the improvement of rigidity, is made with a curved surface so that the connecting portion between between the plate member and the inner wall of the expansion chamber may not be in the same plane perpendicular to the axis of the expansion chamber, to prevent noises from being generated from the outer wall of the muffler and to improve the muffling effect on the exhaust system.

BACKGROUND OF THE INVENTION

Noise is generated with the exhaust of an internal combustion engine for vehicles. Such exhaust noise is caused: by pressure waves generated by the difference between the pressure in the cylinder and that in the exhaust pipe at the moment when the exhaust valve is opened; by resonance in the pipe amplified and generated when the pressure waves reciprocate within the pipe; and by air current, i.e., the current of the exhaust.

An expansion type muffler, resonance type muffler, interference type muffler, sound absorption type muffler, and muffler of a type combining the above mentioned types have already been proposed as a means for eliminating exhaust noise.

In the expansion type muffler, a muffler provided with an expansion chamber of a large volume is connected to piping forming an exhaust system so that the exhaust may be introduced into the expansion chamber, to be expanded, interfered with, noise absorbed, and rectified in the pulsation in this chamber to obtain a silencing effect.

In such expansion type muffler, in the case of introducing the exhaust into the expansion chamber, the exhaust pulsates with the intermittent opening and closing of the exhaust valve of the engine, and the pressure in the expansion chamber of the muffler fluctuates. It has been known that the chamber wall is vibrated by such pressure fluctuation, and that the pulsation pressure within the chamber and the natural frequency of the wall produces sound waves by this vibration so as to be a part of the noise of the exhaust system. To prevent this, the rigidity of the outer wall of the muffler must be improved to provent the vibration, and also the natural frequency of the outer wall must be dispersed as much as possible.

The conventional expansion type mufflers are explainged hereinbelow.

In FIG. 7, a flat partition plate 4 is provided in the intermediate portion in the lengthwise direction of a cylindrical muffler body 1. A pipe 5 for introducing the exhaust is provided in a front wall 2 of the body 1, and a pipe 6 for discharging the exhaust is provided in a rear wall 3. With the partition plate 4, the body 1 is sectioned in the front and rear in the lengthwise direction to have two expansion chambers 8 and 9 which communicate with each other through a connecting pipe 7 provided through the partition plate 4. The exhaust is introduced into the first chamber 8 through the pipe 5 and expands within chamber 8. At the same tine, the sound wave component also expands within the chamber 8, collides with the inner wall and partition plate, and is reflected to be interfered with and attenuated. Then, the exhaust is further introduced into the second chamber 9 through the connecting pipe 7. The above is repeated, and the sound waves are interfered with and attenuated in turn to obtain a silencing effect.

However, the exhaust introduced into the chamber 8 contains a pulsation pressure corresponding to the intermittent opening and closing of the exhaust valve of the engine disposed in the up-stream exhaust side, and therefore the pressure within the chambers 8 and 9 pulsates therewith. Due to this pressure fluctuation, the wall of the body 1 forming the inner wall of the chamber 8 is flexed and displaced with a predetermined amplitude inwardly as shown in the drawing wherein the high rigidity parts a and b are as nodes and the low rigidity part c is as a web or anti-node.

As a result, the vibrations of the two nodes become so large as to cause noises or so-called vibration sounds of the outer wall. In addition, the partition plate 4 is provided in the central part within body 1 so that the lengths of the wall of the body 1 from the front and rear walls 2 and 3 to the partition plate are equal to each other over the entire periphery of the body. Therefore, the wall of body 1 results in having equal natural frequencies as well as the same vibration nodes over the entire periphery thereby making the vibration sounds much greater. Further, because the partition plate 4 is flat, the plate vibrates itself the same as is mentioned above within the body 1, with its middle part acting as a web, and causes internal noises separately from the vibrations of the wall. Noise in the muffler is thus amplified together with the above.

In FIG. 8, a partition plate 104 is provided to traverse in the lengthwise direction in a body 101. The body 101 is sectioned above and below with the partition plate 104 to provide upper and lower expansion chambers 108 and 109. The front and rear walls 102 and 103 are provided respectively with pipes 105 and 106. The chambers 108 and 109 are connected respectively to the upper stream side and lower stream side through the respective pipes 105 and 106. The partition plate 104 is provided with a pipe 107 which makes the chambers 108 and 109 communicate with each other.

The outer wall of the body 101 vibrates as flexed and displaced inwardly and outwardly with the front and rear ends in the lengthwise direction being as knots a and the intermediate part being as a web c, and further the partition plate 104 disposed in substantially parallel with an outer wall vibrates to bring about the same problems as mentioned above.

The present invention eliminates the aforementioned problmes of the expansion type mufflers by taking into consideration that the noise can be prevented as much as possible by increasing the rigidity of the partition plate, reinforcing plate, and outer wall of the muffler to control the vibration and disperse the natural frequency of the outer wall.

SUMMARY OF THE INVENTION

An expansion-type muffler for an exhaust system for an internal combustion engine, comprising a muffler body having a chamber therein communicating with an up-stream side and a down-stream side of an exhaust system. The muffler body has a longitudinal axis. A plate member is disposed substantially transverse to the longitudinal axis of the muffler body. The plate member is connected at various connecting points with an inner wall of the muffler body. All of the connecting points are not disposed in the same plane perpendicular to the longitudinal axis of the muffler body.

An object of the invention is to provide a muffler for internal combustion engines wherein a plate member, connected with the inner wall of a body provided in the exhaust system and having an expansion chamber therein, is so formed that the connecting portion between the plate member and the inner wall may not be in the same plane perpendicular to the axis of the body.

Another object is to provide a muffler wherein the plate member is made as a rigid reinforcing plate formed with a curved surface so that the connecting portion between the inner wall and reinforcing plate may not be in the same plane perpendicular to the axis of the muffler body.

A further object is to provide a muffler wherein the plate member is made as a partition plate, sectioning the muffler body, and provided with a connecting pipe making the sectioned chambers communicate with each other so that the connecting portion between such partition plate and inner wall within the body may not be in the same plane perpendicular to the axis of the body.

In the invention, because the plate member such as the reinforcing plate or partition plate is formed with a curved surface, the rigidity of the plate member and outer wall of the muffler can be increased, and the vibration of the outer wall can be controlled and prevented as much as possible. Further, because the connecting points of the fitting flange of the reinforcing plate or partition plate and the inner wall of the body are not present in the same plane perpendicular to the axis of the body, the distance between the knot parts of the outer wall of the muffler varies in the lengthwise direction over the entire periphery. Therefore, the vibration mode is dispersed, and the natural frequency of the outer wall is also dispersed. Further, the control of the vibration of the outer wall of the muffler caused by the pressure fluctuation by the exhaust pulsation within the expansion chamber and the prevention of noises can be effectively made, and the generation of the vibration sounds of the outer wall plate of the muffler is prevented. Thus, a muffler having a higher silencing effect can be obtained easily and inexpensively.

DETAILED DESCRIPTION

Figure 1:
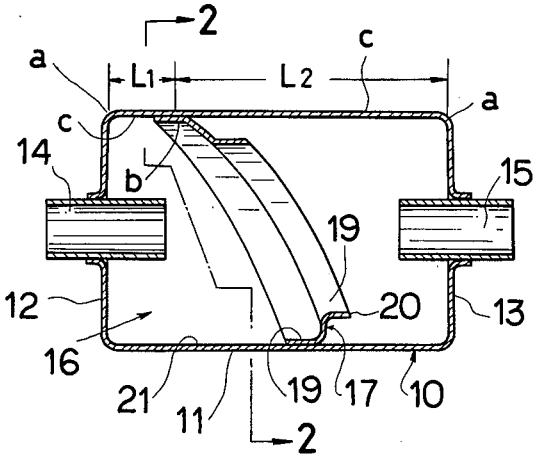
FIG. 1 is a vertically sectioned side view showing the basic structure of a muffler according to the present invention.
Figure 2:
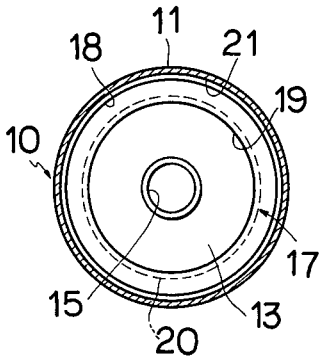
FIG. 2 is a sectioned view on line 2—2 in FIG. 1.

FIGS. 1 and 2 illustrate an embodiment of a muffler 10 having a reinforcing plate 17 therein. The body 11 of muffler 10 is formed to be cylindrical and is closed at the front and rear ends with wall plates 12 and 13. Communicating pipes 14 and 15 are provided in the central parts of plates 12 and 13, respectively. Pipe 14 is connected to the up-stream side of the exhaust. Pipe 15 is connected to the down-stream side of the exhaust. An expansion chamber 16 communicates with the up-stream sides of the exhaust at the front and rear ends of body 11, respectively.

A reinforcing plate 17, provided with a flange portion 18 over the entire outer periphery thereof, is mounted within body 11, and is secured and connected at a flange 18 with an inner wall 21 of body 11 by welding or the like. Plate 17 is provided with a hole 19 in its central part to be formed in a ring-shape, and has a rib 20 formed integrally with the peripheral edge of central hole 19. Reinforcing plate 17 is formed into a bent-shape with a curved surface in its entire configuration and is so formed that all connecting points between flange 18 and inner wall 21 are not in the same plane perpendicular to the axis of body 11. Further, as shown in FIGS. 1 and 2, the connecting points between plate 17 and inner wall 21 of body 11 define a closed-loop, three-dimensional, curved surface of connection between plate 27 and inner wall 21.

Thus, the lengths $L_1$ and $L_2$ between the high rigidity part a of wall plate 12 and the high rigidity part b of body 11 connected with flange 18 of reinforcing plate 17, and between a part a of wall plate 13 and said part b, varies constantly over the entire periphery, with the connecting points lying in different planes perpendicular to the axis of body 11. Therefore, the dimensions $L_1$ and $L_2$ are different in all parts on the periphery over the entire periphery of body 11.

Even if an exhaust, in which pressure varies with the pulsation pressure, is introduced into expansion chamber 16, the vibration modes are different in different parts of the outer wall of the body. Thus, the natural frequency of the web parts c is dispersed as much as possible due to the dimension variation. Thereby, the vibration can be controlled as much as possible. Particularly, owing to the dispersion of the natural frequency, the noises can be controlled and prevented as much as possible, and similarly the generation of vibration sounds by the vibration of the outer wall can be prevented as much as possible. Further, because reinforcing plate 17 has a predetermined curve shape, the strength and rigidity of the plate 17 and the outer wall portion of body 11 is increased to control and prevent the generation of vibrations and noises.

Thus, the noises of the muffler can be effectively prevented by the multiplied effects.

Figure 3:
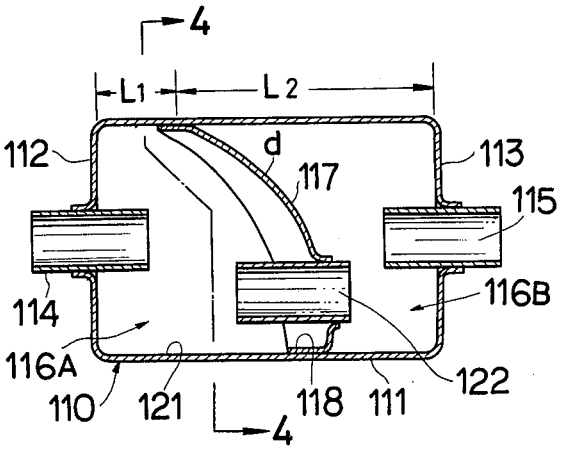
FIG. 3 is the same view as in FIG. 1, showing a modified embodiment of the basic structure.
Figure 4:
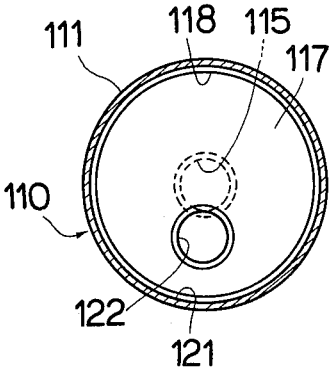
FIG. 4 is a sectioned view on line 4—4 in FIG. 3.

FIGS. 3 and 4 show a second embodiment of the present invention. A body 111 of a muffler 110 is sectioned with a partition plate 117 which is provided with a flange part 118 in the outer peripheral part and connected at the flange 118 with inner wall 121 of body 111 by welding and the like. Partition plate 117 is formed to have a curved surface, and is provided with a communicating pipe 122 in its lower part. Front and rear wall plates 112 and 113 of body 111 are provided with communicating pipes 114 and 115, respectively. The interior of body 111 is sectioned with plate 117 to form a first chamber 116A on the up-stream side, and a second chamber 116B on the down-stream side, communicating with each other through pipe 122.

With the curvature of partition plate 117, the connecting portions of flange 118 with inner wall 121 of body 111 are not present in the same plane perpendicular to the axis of body 111, and the connecting points between plate 117 and inner wall 121 of body 111 define a closed-loop, three-dimensional, curved surface of connection between plate 117 and inner wall 121. Therefore, as described above, the lengths $L_1$ and $L_2$ between the high rigidity parts in the axial direction, i.e., in the lengthwise direction of the peripheral wall of body 111, are different over the entire periphery thereof and the natural frequency of the outer wall is dispersed. And, the generation of vibrations and any accompanying noises can be controlled and prevented. Further, because partition plate 117 which is also a reinforcing plate is curved, the strength and rigidity of the partition plate and the outer wall of the body can be made so high as to multiply the control and prevention of vibrations and noises. Furthermore, because partition plate 117 is curved, also the connecting portion of itself with the inner wall of the body are not present in the same plane perpendicular to the axis of the body so that the web d of partition plate 117 can also control and prevent vibrations and the noises caused by any vibration of this part.

Figure 5:
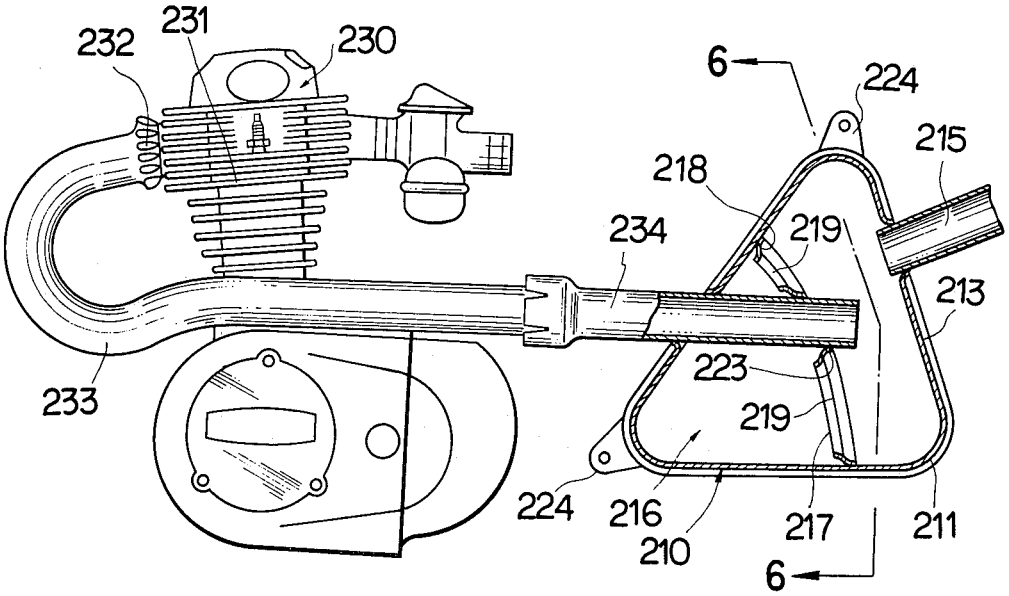
FIG. 5 is a view of an embodiment as applied to an exhaust system of a motorcycle with the part of the muffler being in section.
Figure 6:
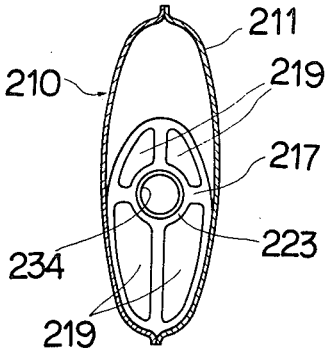
FIG. 6 is a sectioned view on line 6—6 in FIG. 5.
Figure 7:
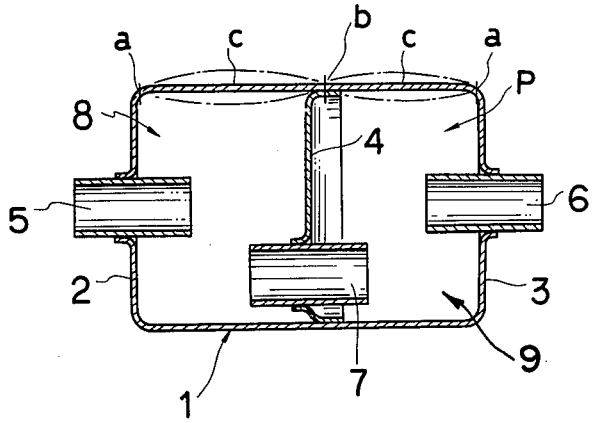
FIG. 7 PRIOR ART
FIGS. 7 and 8 are vertically sectioned views showing examples of conventional mufflers.
Figure 8:
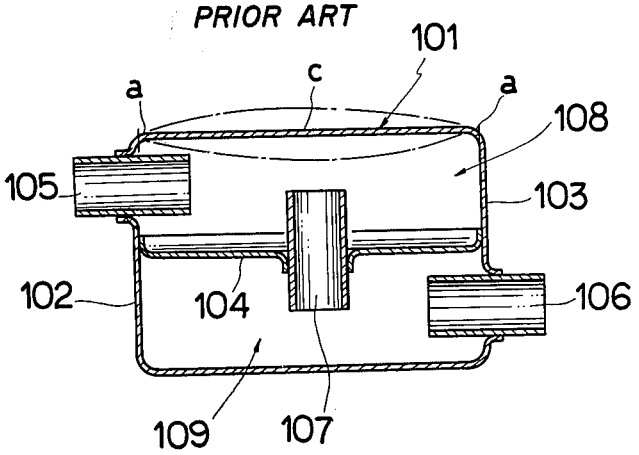
FIG. 8 PRIOR ART

FIG. 5 shows an embodiment of the present invention as applied to a motorcycle. Reference numeral 230 indicates an internal combustion engine of a motorcycle. An exhaust pipe 233 is connected at its base end to an exhaust part 232 of a cylinder 231, and at its terminal end to the outer end of a connecting pipe 234 which in turn is led at its other end into a muffler 210, muffler 210 being triangular in its side view in the illustrated embodiment, and elliptical in the vertical direction as shown in FIG. 6 with the longitudinal section.

Muffler 210 is constructed on the basis of the embodiment in FIG. 1. A reinforcing plate 217 formed as curved is welded and the like at flange 218 to the inner wall of muffler body 211, and is provided with a plurality of holes 219 and with a central hole 223 for supporting connecting pipe 234 at its inner end. A communicating pipe 215 communicating with the down-stream side of the exhaust system is connected to wall 213 of the body opposed to connecting pipe 234. Reference numeral 224 indicates a bracket for mounting the muffler 210 on a car body and the like.

Reinforcing plate 217 is also curved the same as already described relative to the first and second embodiments, and is so constructed that its connecting points with the inner wall of body 211 are not present in the same plane perpendicular to the axis of body 211 to disperse the natural frequency and increase the rigidity of the reinforcing plate.

It should be understood from the foregoing that an expansion-type muffler for motorcycles which has a remarkable silencing performance, i.e., a high effect of controlling vibrations and preventing noises, and is itself very quiet, can be obtained by the present invention.

We claim:

1. An expansion-type muffler for an exhaust system of an internal combustion engine, comprising:

a muffler body having a chamber therein communicating with an up-stream side and a down-stream side of an exhaust system;

said muffler body having a longitudinal axis;

a plate member disposed substantially transverse to said longitudinal axis of said muffler body;

said plate member being connected at various connecting points with an inner wall of said muffler body;

said connecting points between said plate member and said inner wall of said muffler body defining a closed-loop, three-dimensional, curved surface of connection between said plate member and said inner wall; and all of said connecting points are not disposed in the same plane perpendicular to said longitudinal axis of said muffler body.

2. A muffler according to claim 1, wherein:

said plate member is curved to have a curved surface.

3. A muffler according to claim 1 wherein:

said plate member comprises a reinforcing plate having a hole and a flange provided adjacent to the peripheral edge of said hole so that all parts of the portion of said flange connected with said inner wall of said muffler body are not present in the same plane perpendicular to said axis of said muffler body.

4. A muffler according to claim 3, including:

a pipe connecting said chamber with said exhaust system; and said pipe being supported by a portion of said reinforcing plate.

5. A muffler according to claim 1, wherein:

said axis is a central longitudinal axis of said muffler body; and each one of said connecting points is disposed in a different plane perpendicular to said central longitudinal axis of said muffler body.

6. A muffler according to claim 1, 2, 3, 4 or 5, wherein:

said plate member is a partition plate sectioning the interior of said muffler body into two sections;

said plate member is curved to have a curved surface; and said plate member is provided with a pipe making said two sections of said body communicate with each other so that the connecting portion between a flange part provided in the peripheral edge of said partition plate and said inner wall of said body may not be present in the same plane perpendicular to the axis of said body.

* * * * *